US005697360A

United States Patent [19]

Cigarini et al.

[11] Patent Number: 5,697,360

[45] Date of Patent: Dec. 16, 1997

[54] OVEN STRUCTURE ASSOCIABLE WITH ELECTRICAL OR GAS ELEMENTS TO DEFINE AN ELECTRIC OR GAS OVEN

[75] Inventors: Enzo Cigarini, Brebbia; Alessandro Distaso, Gemonio, both of Italy

[73] Assignee: Whirlpool Europe B.V., Veldhoven, Netherlands

[21] Appl. No.: 527,052

[22] Filed: Sep. 12, 1995

[30] Foreign Application Priority Data

Sep. 13, 1994 [IT] Italy ..... MI94A1876

[51] Int. Cl.[6] ..... A21B 1/00

[52] U.S. Cl. ..... 126/19 R; 126/21 R; 126/39 BA; 126/39 R; 126/273 R; 219/400

[58] Field of Search ..... 126/39 BA, 39 R, 126/39 C, 39 M, 21 R, 21 A, 273 R, 275 E, 274, 80, 19 R; 219/400

[56] References Cited

U.S. PATENT DOCUMENTS

| | | | |
|---|---|---|---|
| 2,511,328 | 6/1950 | Cline | 126/39 BA X |
| 2,796,060 | 6/1957 | Binns | 126/39 BA |
| 2,944,139 | 7/1960 | Harris, Jr. et al. | 126/39 M X |
| 3,145,289 | 8/1964 | Swetlitz | 126/39 M X |
| 3,423,568 | 1/1969 | Meckley, III et al. | 392/310 |
| 4,585,923 | 4/1986 | Binder | 126/21 A X |
| 5,275,147 | 1/1994 | Aktinson, III | 126/39 BA |

FOREIGN PATENT DOCUMENTS

| | | | |
|---|---|---|---|
| 24 35 138 | 12/1976 | Germany | A21B 1/26 |
| 35 33 589 | 9/1986 | Germany | A21B 1/02 |
| 2042310 | 9/1980 | United Kingdom | 126/39 BA |

*Primary Examiner*—Larry Jones

*Attorney, Agent, or Firm*—Mark A. Davis; Thomas A. Schwyn

[57] ABSTRACT

An oven structure (1) comprises a casing (2) provided with walls (5, 6, 7, 8, 9) defining a cooking chamber (4) open on one side (4A) of said casing (2), and below said casing (2) an element (20) provided with a cavity (19) defined by walls (21, 22, 23, 26) rising from the lower wall (24) of said element (20), said cavity (19) facing the lower wall (8) of said casing (2). At least part (26) of said element (20) is removable to allow connection to a gas heating member (29), said cavity (19) being able at choice either to receive an electrical heating member (60) or become the seat of a hot air stream generated by the gas member (29), the lower wall (8) of said casing (2) being provided with apertures (16) which are preferably closed when the cavity (19) of the lower element (20) contains the electrical heating member (60) and are open when said lower element (20) is connected to the gas heating member (29).

11 Claims, 2 Drawing Sheets

OVEN STRUCTURE ASSOCIABLE WITH ELECTRICAL OR GAS ELEMENTS TO DEFINE AN ELECTRIC OR GAS OVEN

This invention relates to an oven structure in accordance with the introduction to the main claim.

Ovens provided with electrical heating members and ovens provided with gas heating members are both known. In "electric" ovens these heating members are provided at the roof, at the rear wall and at the lower wall of the cooking chamber; in contrast, in most "gas" ovens there is a region below the lower wall containing a usual gas burner comprising several rectilinear regions from which the flames are generated.

Gas ovens are also known in which the region from which the hot air formed by the gas burner is fed is located to the side or rear of the cooking chamber. For example, U.S. Pat. No. 4,867,132 describes a gas oven in which the hot air produced by the gas combustion is forcibly fed into the cooking chamber through one side thereof. Specifically, at this side there is provided a compartment containing a fan and receiving the air heated by the burner positioned below said compartment. This arrangement is however of complicated construction and in particular implies an oven of considerable size to prevent limitation of the useful cooking chamber volume because of the presence of the lateral fan, its containing compartment and the burner.

U.S. Pat. No. 4,492,216 describes another forced-air gas oven in which the burner is positioned in a chamber provided to the side of the cooking chamber. The air reaches this latter through channels provided adjacent to one side of this chamber and opening into it via suitable nozzles. The air is then drawn to the outside of the cooking chamber via further channels connected to a compartment containing a turbine for recycling this air to the burner. This arrangement is also complicated and results in an increase in oven dimensions.

In all cases the known electric or gas oven arrangements (fan-assisted or natural convection) involve different oven structures depending on the heating member with which they are associated. This implies different methods for forming such structures and hence considerable industrial costs to the manufacturer.

An object of the invention is to provide an oven structure which can be associated with electrical heating members or gas heating members at choice, hence enabling the aforesaid drawbacks of known arrangements to be overcome.

A particular object of the invention is to provide a structure of the stated type which, depending on market requirements and need, can be easily used for forming an electric oven or a gas oven, so reducing the industrial costs involved in constructing such ovens. A further object is to provide a structure which is of simple construction and allows easy maintenance of the heating members associated with it.

A further object is to provide a structure of the stated type which when used to form a gas oven results in improved gas combustion with a reduction in pollutants such as nitrogen oxides and carbon monoxide.

A further object is to provide a structure of the stated type which allows a gas or electric oven to be formed in which the cooking chamber is of the same dimensions as the cooking chambers of usual already known ovens, and in which there is improved heat distribution with consequent saving in terms of energy consumption.

A further object is to provide an oven structure in which forced air circulation can be achieved.

These and further objects which will be apparent to the expert of the art are attained by an oven structure in accordance with the accompanying claims.

The present invention will be more apparent from the accompanying drawing, which is provided by way of non-limiting example and in which:

DESCRIPTION OF THE PREFERRED EMBODIMENT

Figure 1:
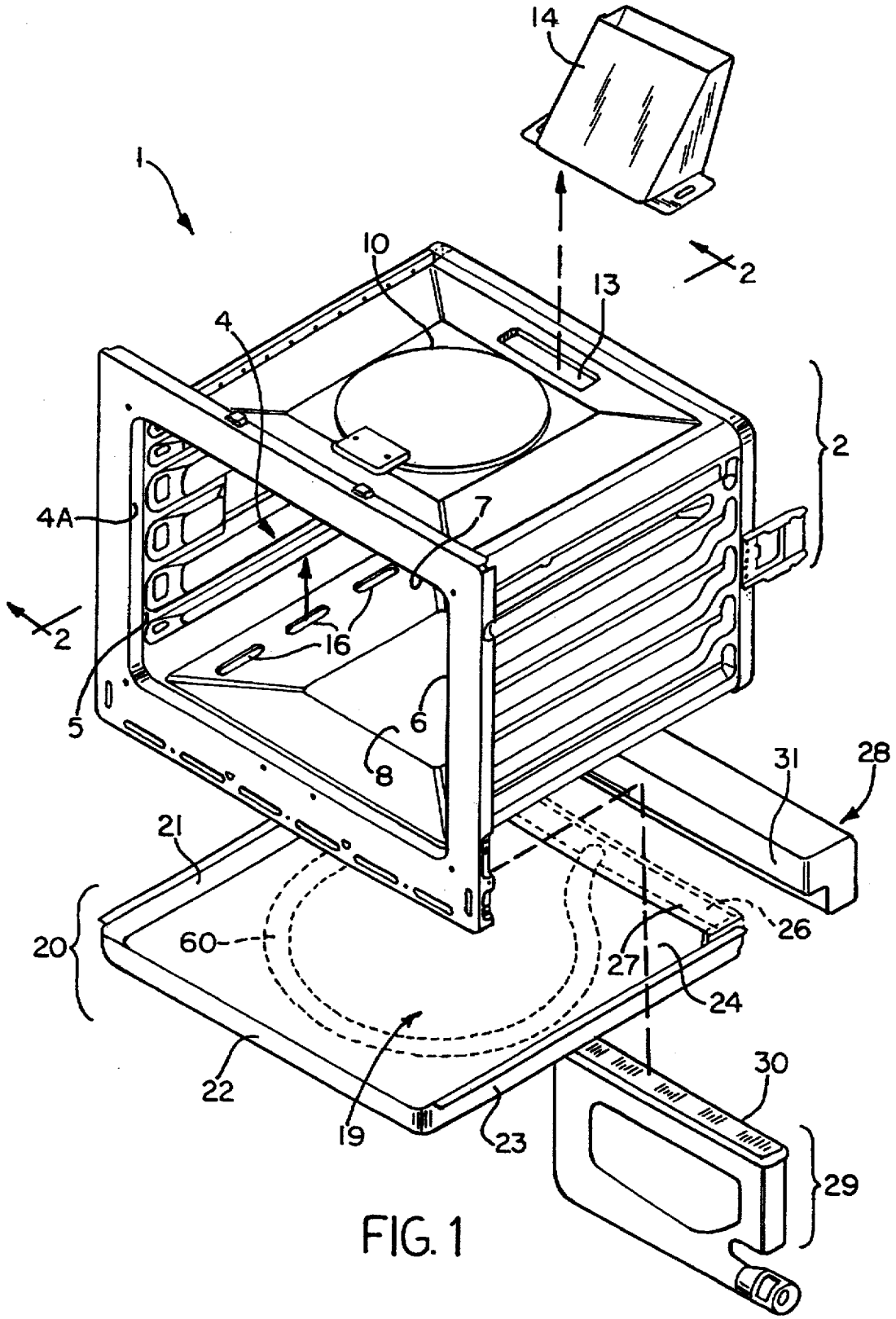
FIG. 1 is an exploded view of a structure according to the invention used for forming a gas oven.

With reference to said figures, the structure according to the invention is indicated overall by 1 and comprises a casing 2 of substantially parallelepiped form in which there is provided an internal cavity or cooking chamber 4 open on one side 4A and bounded by side walls 5, 6, a roof 7, a lower wall 8 and a rear wall 9. Between the roof 7 and an upper outer surface or wall 10 of the casing 2 there is a corridor 11 opening at 13 into this surface. At the aperture 13 there is provided a channel or stack 14 of polygonal cross-section with its longitudinal axis W cutting the surface 10 at an angle ($\alpha$) other than 90°.

The lower wall 8 comprises a plurality of elongate slots 16 provided in proximity to the side walls 5 and 6. The slots 16 connect the cooking chamber 4 to a cavity 19 provided in an element 20 positioned below said casing 2.

The cavity 19 of the lower element 20 is bounded on three sides by fixed walls 21, 22 and 23 rising from a lower wall 24. The cavity 19 is also bounded by a further removable wall 26 (shown by dashed lines in FIG. 1) which when absent frees a passage 27 to which there is fitted an angular element 28 connected to a gas heating member and/or burner 29 provided with a diffuser 30. The angular element 28 is hollow at 31 and connects the heating member 29 to the cavity 19.

Figure 2:
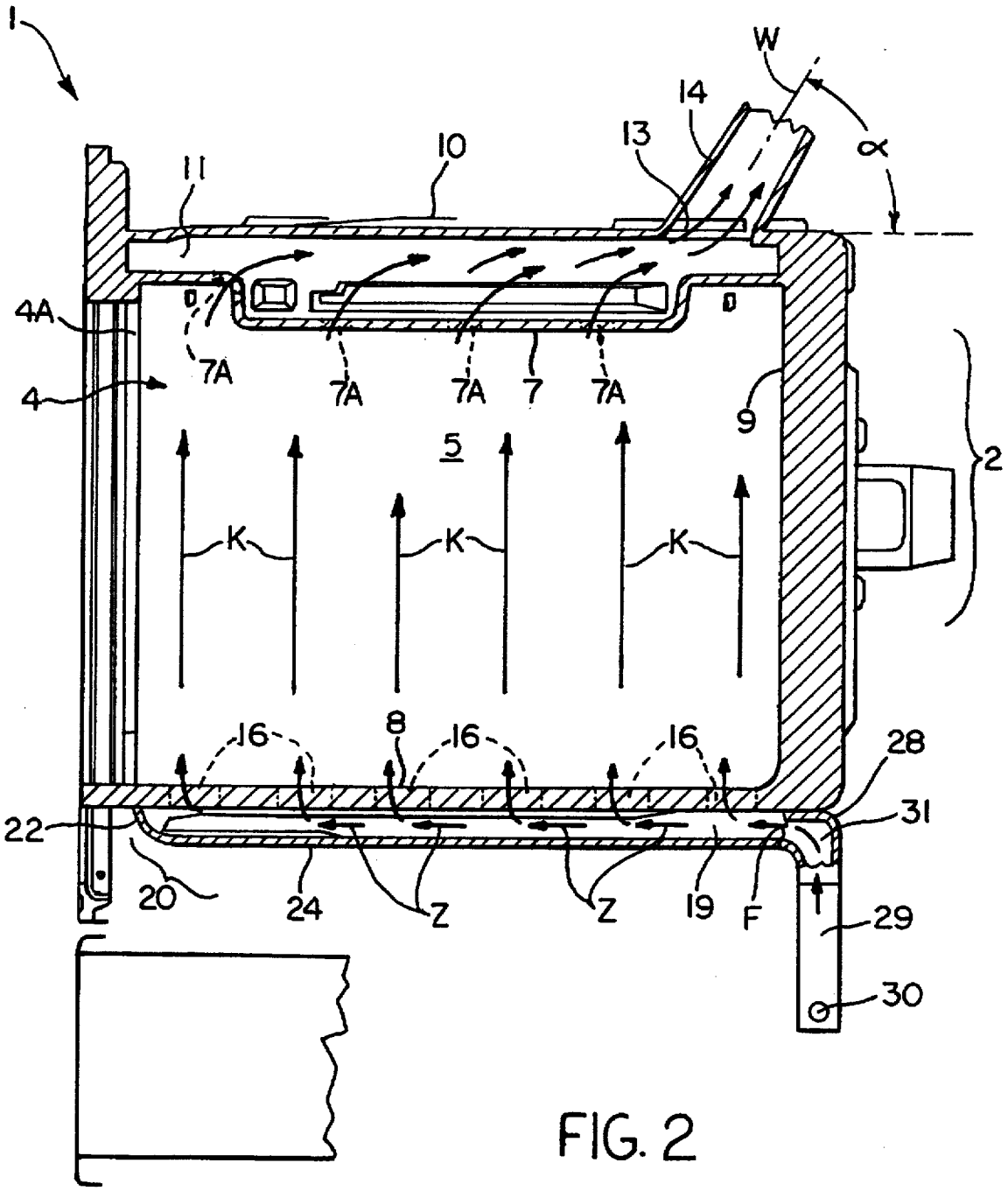
FIG. 2 is a schematic section on the line 2—2 of FIG. 1 with the oven assembled.

When the structure 1 is assembled, ie the gas oven ready for use, the diffuser 30 is operated and the hot air and combustion products hence generated pass into the element 28 (arrows F in FIG. 2) and from here into the cavity 19 of the element 20 (arrows Z in FIG. 2). The cavity 19 hence becomes the seat of a hot air and combustion gas stream which passes into the cooking chamber 5 (arrows K in FIG. 2) to strike the food (not shown) present therein. By natural convection this air is then drawn into the corridor 11 through slots 7A in the roof 7 of the chamber 5 and from this corridor is expelled from the oven via the stack A fan can be provided (positioned preferably within the casing 2, for example in the corridor 11) to allow forced air circulation within the cooking chamber. In this case the roof 7 is shaped for example in a similar manner to the wall (for example the rear wall) of fan-assisted electric ovens to enable the fan to draw air into the corridor 11, said corridor being connected, for example via the aperture 13, to a duct (not shown) which feeds the air to the heating member 29.

The apertures 16 in the wall 8 of the casing 2 are open, as stated. These apertures can be closed (for example by a suitably shaped closure member, not shown) when the structure 1 is used to form an electric oven. In this case a usual electrical resistance element 60 (shown by dashed lines in FIG. 1) is positioned within the cavity 19 of the lower element 20, other electrical heating members being located in known positions at the roof 7 and beyond the wall 9 of the chamber 4. In addition this cavity is closed on all its sides, ie in other words to the walls 21, 22 and 23 there is added the wall 26 which advantageously supports the electrical heating member.

Using the invention it is therefore possible to form either an electric oven or a gas oven according to requirements. In this respect, if an electric oven is required, the apertures 16 are closed and the cavity 19 contains the electrical resistance element 60 advantageously fixed to the wall 26 which together with the walls 21, 22 and 23 closes said cavity. If however a gas oven is required, the wall 26 is removed and the aperture 27 hence formed is connected to the gas heating member 29. At the same time the apertures 16 are opened to allow passage of hot air. Hence the structure 1 (comprising the casing 2 and the element 20) can be used at choice to form either a gas oven or an electric oven according to requirements.

Different embodiments of the invention have been described. Other embodiments are however possible (such as one in which only part of the wall 26 is removable for connection to the gas heating member) without leaving the scope of the present invention.

We claim:

1. An oven structure comprising a casing provided with walls defining a cooking chamber open on one side of said casing, and below said casing an element provided with a cavity defined by walls rising from the lower wall of said element, said cavity facing the lower wall of said casing, characterised in that the cavity of said lower element is able to receive an electrical heating member or become the seat of a hot air stream generated by a gas heating member, for which purpose at least part of said lower element is removable to allow connection to said gas heating member.

2. An oven structure as claimed in claim 1, characterized in that part of the lower element removable for connection to the gas heating member is at least a portion of a wall bounding the internal cavity of said element.

3. An oven structure as claimed in claim 1, characterised in that the removable part of the lower element is arranged to support the electrical heating member when present.

4. An oven structure as claimed in claim 1, characterised by comprising a member for connecting the gas heating member to the lower element.

5. An oven structure as claimed in claim 4, characterised in that the connection member is angular and the gas heating member is vertical.

6. An oven structure as claimed in claim 4, characterised in that the connection member is removably associated with the gas heating member.

7. An oven structure as claimed in claim 4, characterised in that the connection member is part of the gas heating member.

8. An oven structure as claimed in claim 1, characterised in that the casing comprises, between the roof of the cooking chamber and an outer upper wall of said casing, a corridor connected to said chamber via through apertures provided in said roof, said corridor opening to the outside of the casing.

9. An oven structure as claimed in claim 8, characterised in that the aperture by which the corridor opens to the outside of the casing is connected to a stack.

10. An oven structure as claimed in claim 1, characterised in that the hot air circulation is of forced convection type.

11. An oven structure as claimed in claim 1, wherein the lower wall of said casing is provided with apertures when the lower element is connected to the gas heating member.

* * * * *